US011913647B2

(12) United States Patent
Shershnyov

(10) Patent No.: US 11,913,647 B2
(45) Date of Patent: Feb. 27, 2024

(54) COMBUSTOR NOZZLE, COMBUSTOR, AND GAS TURBINE INCLUDING THE SAME

(71) Applicant: DOOSAN ENERBILITY CO., LTD., Changwon (KR)

(72) Inventor: Borys Shershnyov, Changwon (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 18/164,636

(22) Filed: Feb. 6, 2023

(65) Prior Publication Data

US 2023/0266011 A1 Aug. 24, 2023

(30) Foreign Application Priority Data

Feb. 21, 2022 (KR) ..... 10-2022-0022450

(51) Int. Cl.
*F23R 3/28* (2006.01)
*F23R 3/14* (2006.01)

(52) U.S. Cl.
CPC ..... *F23R 3/286* (2013.01); *F23R 3/14* (2013.01)

(58) Field of Classification Search
CPC .... F23R 3/12; F23R 3/14; F23R 3/286; F23R 3/32; F05D 2260/14; F05D 2260/127; F23D 14/64; F23D 2900/14021; F23D 2900/14701; F23C 2900/07001
See application file for complete search history.

(56) References Cited

U.S. PATENT DOCUMENTS

| | | | | |
|---|---|---|---|---|
| 4,013,395 | A | 3/1977 | Wormser | |
| 4,100,733 | A | 7/1978 | Striebel | |
| 9,243,803 | B2 * | 1/2016 | Berry | F23R 3/283 |
| 9,534,787 | B2 * | 1/2017 | Westmoreland | F23R 3/286 |
| 2008/0276622 | A1 * | 11/2008 | Johnson | F23R 3/286 60/800 |
| 2011/0083439 | A1 | 4/2011 | Zuo | |
| 2013/0104556 | A1 | 5/2013 | Uhm | |
| 2013/0122434 | A1 | 5/2013 | Stoia | |
| 2013/0122435 | A1 | 5/2013 | Stoia | |
| 2013/0232979 | A1 * | 9/2013 | Singh | F23R 3/286 60/737 |
| 2014/0033718 | A1 | 2/2014 | Manoharan | |
| 2014/0157779 | A1 | 6/2014 | Uhm | |

(Continued)

FOREIGN PATENT DOCUMENTS

| | | | |
|---|---|---|---|
| JP | 2013170813 | A | 9/2013 |
| JP | 2014-173839 | A | 9/2014 |

(Continued)

OTHER PUBLICATIONS

KR OA, dated Jul. 20, 2023.
The EP EESR, dated Oct. 18, 2023.
The KR Notice of Allowance, dated Nov. 21, 2023.

*Primary Examiner* — Todd E Manahan
*Assistant Examiner* — Sean V Meiller

(57) ABSTRACT

Disclosed herein is a nozzle for a combustor that burns fuel containing hydrogen, which includes a plurality of mixing tubes through which air and fuel flow, a multi-tube configured to contain and support the mixing tubes, a fuel tube formed inside the multi-tube and through which fuel flows, a tip plate coupled to a tip of the multi-tube, and a front plate spaced apart from the tip plate to define a cooling space.

19 Claims, 6 Drawing Sheets

(56) References Cited

U.S. PATENT DOCUMENTS

| | | | |
|---|---|---|---|
| 2015/0135718 | A1 | 5/2015 | Hughes |
| 2016/0033133 | A1 | 2/2016 | Johnson |
| 2018/0066847 | A1 | 3/2018 | Stoia |
| 2019/0212010 | A1 | 7/2019 | Yoshino |
| 2022/0003167 | A1 | 1/2022 | Shershnyov |

FOREIGN PATENT DOCUMENTS

| | | | |
|---|---|---|---|
| JP | 2015-14400 | A | 1/2015 |
| JP | 6067364 | B2 | 1/2017 |
| JP | 2017-150806 | A | 8/2017 |
| JP | 2019100607 | A | 6/2019 |
| KR | 20150085748 | A | 7/2015 |
| KR | 20190040666 | A | 4/2019 |
| KR | 20190040667 | A | 4/2019 |
| KR | 1020190128282 | A | 11/2019 |
| WO | 2022015321 | A1 | 1/2022 |

* cited by examiner

COMBUSTOR NOZZLE, COMBUSTOR, AND GAS TURBINE INCLUDING THE SAME

CROSS-REFERENCE TO RELATED APPLICATION

This application claims priority to Korean Patent Application No. 10-2022-0022450, filed on Feb. 21, 2023, the disclosure of which is incorporated herein by reference in its entirety.

BACKGROUND

Technical Field

Exemplary embodiments relate to a combustor nozzle, a combustor, and a gas turbine including the same, and more particularly, to a combustor nozzle using fuel containing hydrogen, a combustor, and a gas turbine including the same.

Related Art

A gas turbine is a power engine that mixes air compressed by a compressor with fuel for combustion and rotates a turbine with hot gas produced by the combustion. The gas turbine is used to drive a generator, an aircraft, a ship, a train, etc.

The gas turbine typically includes a compressor, a combustor, and a turbine. The compressor sucks and compresses outside air, and then transmits the compressed air to the combustor. The air compressed by the compressor becomes high pressure and high temperature. The combustor mixes the compressed air flowing from the compressor with fuel and burns a mixture thereof. The combustion gas produced by the combustion is discharged to the turbine. Turbine blades in the turbine are rotated by the combustion gas, thereby generating power. The generated power is used in various fields, such as generating electric power and actuating machines.

Fuel is injected through nozzles installed in each combustor section of the combustor, and the nozzles allow for injection of gas fuel and liquid fuel. In recent years, it is recommended to use hydrogen fuel or fuel containing hydrogen to inhibit the emission of carbon dioxide.

However, since hydrogen has a high combustion rate, when hydrogen fuel or fuel containing hydrogen is burned in a gas turbine combustor, the flame formed in the gas turbine combustor approaches and heats the structure of the gas turbine combustor, which may cause a problem with the reliability of the gas turbine combustor.

In addition, in a gas turbine that burns hydrogen, it is necessary to efficiently cool a nozzle tip part in order to prevent deterioration of the nozzle tip part.

SUMMARY

Aspects of one or more exemplary embodiments provide a combustor nozzle having a nozzle tip part capable of being efficiently cooled, a combustor, and a gas turbine including the same. In addition, Aspects of one or more exemplary embodiments provide a combustor nozzle capable of uniformly mixing fuel and air, a combustor, and a gas turbine including the same.

Additional aspects will be set forth in part in the description which follows and, in part, will become apparent from the description, or may be learned by practice of the exemplary embodiments.

According to an aspect of an exemplary embodiment, there is provided a nozzle for a combustor that burns fuel containing hydrogen, which includes a plurality of mixing tubes through which air and fuel flow, a multi-tube configured to contain and support the mixing tubes, a fuel tube formed inside the multi-tube and through which fuel flows, a tip plate coupled to a tip of the multi-tube, and a front plate spaced apart from the tip plate to define a cooling space.

The front plate may include a center hole connected to the fuel tube, and an outer hole disposed outside the center hole to allow fuel to pass therethrough.

The multi-tube may be equipped with a rear plate disposed at a rear end thereof, and with a manifold plate spaced apart from the rear plate to define a distribution space.

Each of the mixing tubes may be equipped with at least one mixing guide extending spirally.

The at least one mixing guide may consist of a plurality of mixing guides installed in the mixing tube, and the mixing guides may be fixed to an inner wall of the mixing tube and spaced apart from each other in a circumferential direction of the mixing tube.

Each of the mixing guides may include a spiral part extending spirally and a guide plate protruding from the spiral part toward an inlet and having a flat shape.

The mixing tube may include an inlet formed at one longitudinal end thereof to introduce air through the inlet, an injection port formed at the other longitudinal end thereof to inject, a mixture in which fuel and air are premixed, through the injection port, and a first injection hole formed on an outer peripheral surface thereof to inject fuel to the inside through the first injection hole.

The mixing guide may be positioned between the first injection holes.

The guide plate may have a chamber for accommodation of fuel therein and a second injection hole through which fuel is injected.

The guide plate may have an inclined surface formed at a portion thereof toward the inlet to be inclined with respect to an inner peripheral surface of the mixing tube, and the second injection hole may be formed on the inclined surface.

A first gap between a radially central portion of the front plate and the tip plate may be smaller than a second gap formed between a radially outer portion of the front plate and the tip plate.

The front plate may be formed to be inclined rearward from the radial center thereof toward the outside.

According to an aspect of another exemplary embodiment, there is provided a combustor including a burner having a plurality of nozzles for injecting fuel and air, and a duct assembly coupled to one side of the burner to burn a mixture of the fuel and the air therein and transmit combustion gas to a turbine. Each of the nozzles includes a plurality of mixing tubes through which air and fuel flow, a multi-tube configured to contain and support the mixing tubes, a fuel tube formed inside the multi-tube and through which fuel flows, a tip plate coupled to a tip of the multi-tube, and a front plate spaced apart from the tip plate to define a cooling space.

The front plate may include a center hole connected to the fuel tube, and an outer hole disposed outside the center hole to allow fuel to pass therethrough.

The multi-tube may be equipped with a rear plate disposed at a rear end thereof, and with a manifold plate spaced apart from the rear plate to define a distribution space.

Each of the mixing tubes may be equipped with a plurality of mixing guides extending spirally, and the mixing guides may be fixed to an inner wall of the mixing tube and spaced apart from each other in a circumferential direction of the mixing tube.

Each of the mixing guides may include a spiral part extending spirally and a guide plate protruding from the spiral part toward an inlet and having a flat shape.

The guide plate may have a chamber for accommodation of fuel therein and a second injection hole through which fuel is injected.

According to an aspect of a further exemplary embodiment, there is provided a gas turbine including a compressor configured to compress air introduced thereinto from the outside, a combustor configured to mix fuel with the air compressed by the compressor for combustion, and a turbine having a plurality of turbine blades rotated by combustion gas produced by the combustion in the combustor. The gas turbine including a compressor configured to compress air introduced thereinto from the outside, a combustor configured to mix fuel with the air compressed by the compressor for combustion, and a turbine having a plurality of turbine blades rotated by combustion gas produced by the combustion in the combustor. Each of the nozzles includes a plurality of mixing tubes through which air and fuel flow, a multi-tube configured to contain and support the mixing tubes, a fuel tube formed inside the multi-tube and through which fuel flows, a tip plate coupled to a tip of the multi-tube, and a front plate spaced apart from the tip plate to define a cooling space.

The front plate may include a center hole connected to the fuel tube, and an outer hole disposed outside the center hole to allow fuel to pass therethrough.

Each of the mixing tubes may be equipped with a plurality of mixing guides extending spirally, and the mixing guides may be fixed to an inner wall of the mixing tube and spaced apart from each other in a circumferential direction of the mixing tube.

It is to be understood that both the foregoing general description and the following detailed description of exemplary embodiments are exemplary and explanatory and are intended to provide further explanation of the disclosure as claimed.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
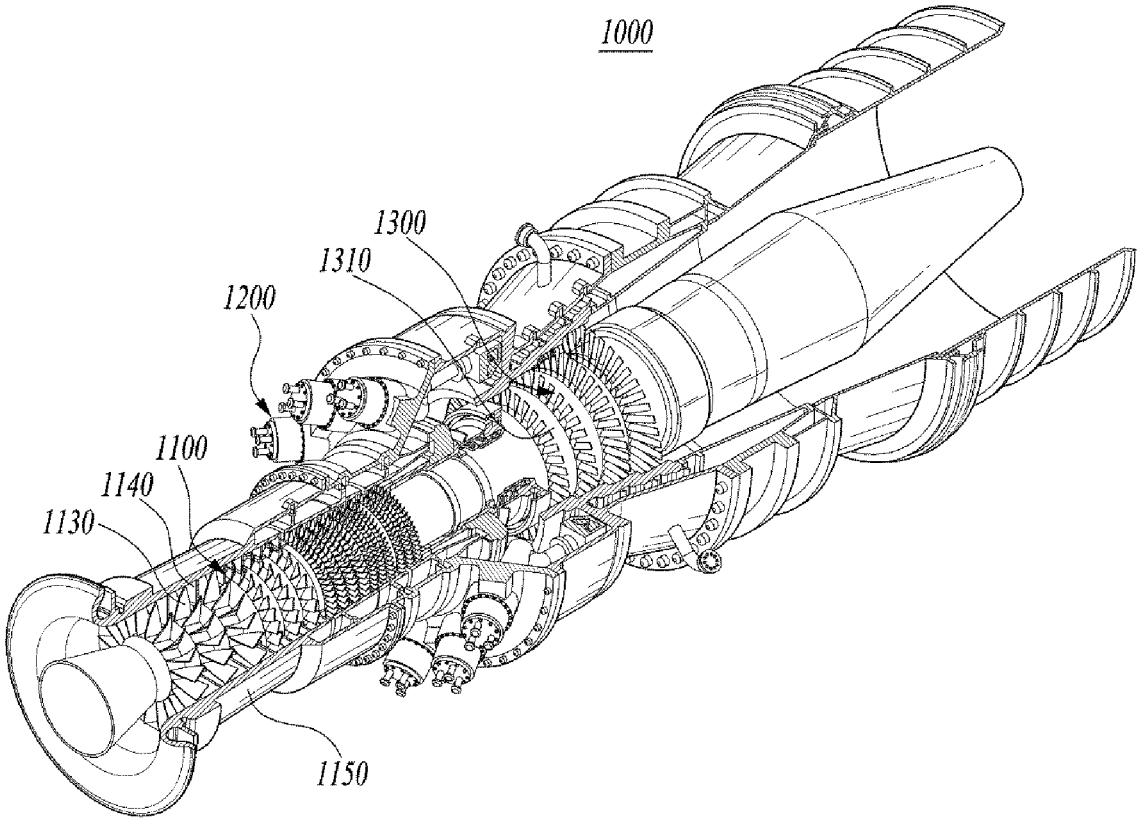
FIG. 1 is a view illustrating an interior of a gas turbine according to a first exemplary embodiment.

Various modifications and different embodiments will be described below in detail with reference to the accompanying drawings so that those skilled in the art can easily carry out the disclosure. It should be understood, however, that the present disclosure is not intended to be limited to the specific embodiments, but the present disclosure includes all modifications, equivalents or replacements that fall within the spirit and scope of the disclosure as defined in the following claims.

The terminology used herein is for the purpose of describing specific embodiments only and is not intended to limit the scope of the disclosure. As used herein, the singular forms "a", "an" and "the" are intended to include the plural forms as well, unless the context clearly indicates otherwise. In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof.

Exemplary embodiments will be described below in detail with reference to the accompanying drawings. It should be noted that like reference numerals refer to like parts throughout various drawings and exemplary embodiments. In certain embodiments, a detailed description of functions and configurations well known in the art may be omitted to avoid obscuring appreciation of the disclosure by those skilled in the art. For the same reason, some components may be exaggerated, omitted, or schematically illustrated in the accompanying drawings.

Hereinafter, a gas turbine according to a first exemplary embodiment will be described.

Figure 2:
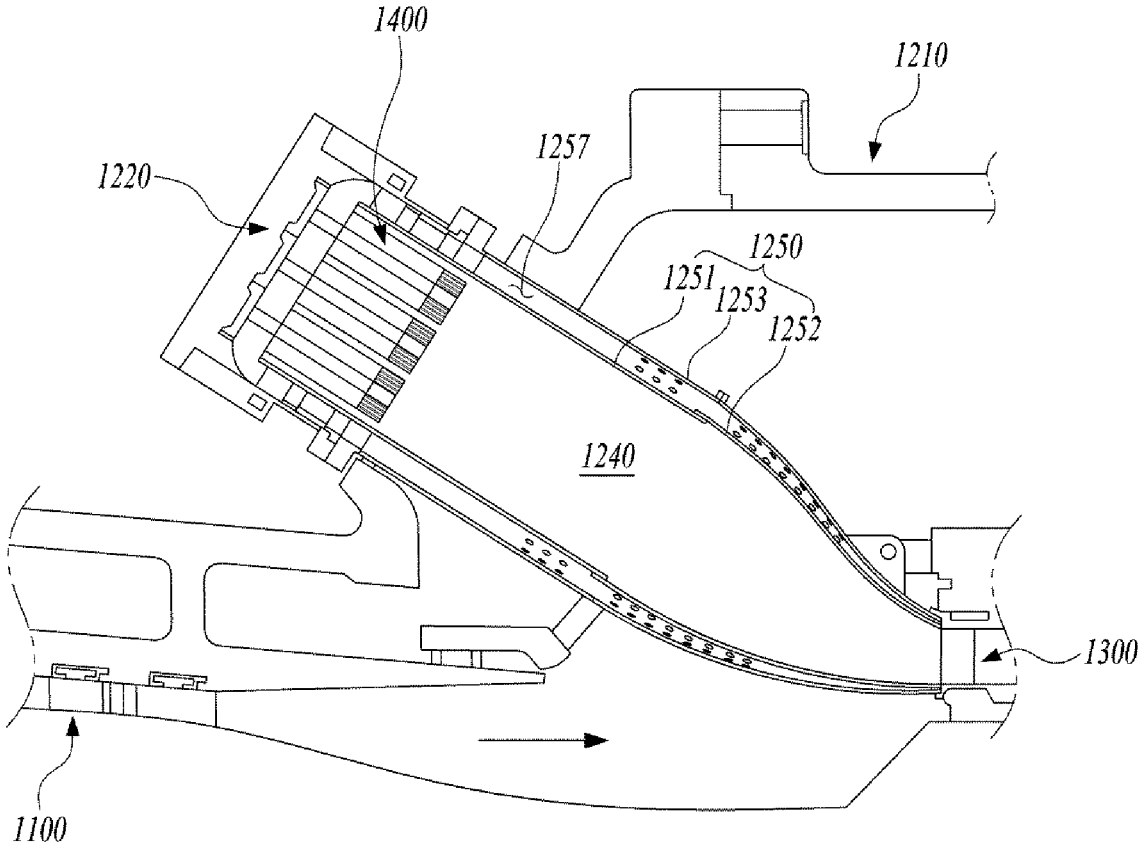
FIG. 2 is a view illustrating the combustor of FIG. 1.

FIG. 1 is a view illustrating the interior of the gas turbine according to the first exemplary embodiment. FIG. 2 is a view illustrating the combustor of FIG. 1.

The thermodynamic cycle of the gas turbine, which is designated by reference numeral 1000, according to the present embodiment may ideally follow a Brayton cycle. The Brayton cycle may consist of four phases including isentropic compression (adiabatic compression), isobaric heat addition, isentropic expansion (adiabatic expansion), and isobaric heat dissipation. In other words, in the Brayton cycle, thermal energy may be released by combustion of fuel in an isobaric environment after the atmospheric air is sucked and compressed to a high pressure, hot combustion gas may be expanded to be converted into kinetic energy, and exhaust gas with residual energy may then be discharged to the atmosphere. The Brayton cycle may consist of four processes, i.e., compression, heating, expansion, and exhaust.

The gas turbine 1000 using the above Brayton cycle may include a compressor 1100, a combustor 1200, and a turbine 1300, as illustrated in FIG. 1. Although the following description is given with reference to FIG. 1, the present disclosure may be widely applied to a turbine engine having the same configuration as the gas turbine 1000 exemplarily illustrated in FIG. 1.

Referring to FIG. 1, the compressor 1100 of the gas turbine 1000 may suck air from the outside and compress the air. The compressor 1100 may supply the combustor 1200 with the air compressed by compressor blades 1130, and may supply cooling air to a hot region required for cooling in the gas turbine 1000. In this case, since the air sucked into the compressor 1100 is subject to an adiabatic compression process therein, the pressure and temperature of the air that has passed through the compressor 1100 increase.

The compressor 1100 is designed as a centrifugal compressor or an axial compressor. In general, the centrifugal compressor is applied to a small gas turbine, whereas the multistage axial compressor is applied to the large gas turbine 1000 as illustrated in FIG. 1 because it is necessary to compress a large amount of air. In the multistage axial compressor, the compressor blades 1130 of the compressor 1100 rotate along with the rotation of rotor disks to compress air introduced thereinto while delivering the compressed air to rear-stage compressor vanes 1140. The air is compressed increasingly to a high pressure while passing through the compressor blades 1130 formed in a multistage manner.

A plurality of compressor vanes 1140 may be formed in a multistage manner and mounted in a compressor casing 1150. The compressor vanes 1140 guide the compressed air, which flows from front-stage compressor blades 1130, to rear-stage compressor blades 1130. In an exemplary embodiment, at least some of the plurality of compressor vanes 1140 may be mounted so as to be rotatable within a fixed range for regulating the inflow rate of air or the like.

The compressor 1100 may be driven by some of the power output from the turbine 1300. To this end, the rotary shaft of the compressor 1100 may be directly connected to the rotary shaft of the turbine 1300, as illustrated in FIG. 1. In the large gas turbine 1000, the compressor 1100 may require almost half of the power generated by the turbine 1300 for driving. Accordingly, the overall efficiency of the gas turbine 1000 can be enhanced by directly increasing the efficiency of the compressor 1100.

The turbine 1300 includes a plurality of rotor disks 1310, a plurality of turbine blades radially arranged on each of the rotor disks 1310, and a plurality of turbine vanes. Each of the rotor disks 1310 has a substantially disk shape and has a plurality of grooves formed on the outer peripheral portion thereof. The grooves are each formed to have a curved surface so that the turbine blades are inserted into the grooves, and the turbine vanes are mounted in a turbine casing. The turbine vanes are fixed so as not to rotate and serve to guide the direction of flow of the combustion gas that has passed through the turbine blades. The turbine blades generate rotational force while rotating by the combustion gas.

Meanwhile, the combustor 1200 may mix the compressed air, which is supplied from the outlet of the compressor 1100, with fuel for isobaric combustion to produce combustion gas with high energy. FIG. 2 illustrates an example of the combustor 1200 applied to the gas turbine 1000. The combustor 1200 may include a combustor casing 1210, a burner 1220, a nozzle 1400, and a duct assembly 1250.

The combustor casing 1210 may have a substantially circular shape so as to surround a plurality of burners 1220. The burners 1220 may be disposed along the annular combustor casing 1210 downstream of the compressor 1100. Each of the burners 1220 includes a plurality of nozzles 1400, and the fuel injected from the nozzles 1400 is mixed with air at an appropriate rate so that the mixture thereof is suitable for combustion.

The gas turbine 1000 may use gas fuel, especially fuel containing hydrogen. The fuel may be either hydrogen fuel alone or fuel containing hydrogen and natural gas.

Compressed air is supplied to the nozzles 1400 along the outer surface of the duct assembly 1250, which connects an associated one of the burners 1220 to the turbine 1300 so that hot combustion gas flows through the duct assembly 1250. In this process, the duct assembly 1250 heated by the hot combustion gas is properly cooled.

The duct assembly 1250 may include a liner 1251, a transition piece 1252, and a flow sleeve 1253. The duct assembly 1250 has a double structure in which the flow sleeve 1253 surrounds the liner 1251 and the transition piece 1252. The liner 1251 and the transition piece 1252 are cooled by the compressed air permeated into an annular space inside the flow sleeve 1253.

The liner 1251 is a tubular member connected to the burner 1220 of the combustor 1200, and the combustion chamber 1240 is a space within the liner 1251. The liner 1251 has one longitudinal end coupled to the burner 1220 and the other longitudinal end coupled to the transition piece 1252.

The transition piece 1252 is connected to the inlet of the turbine 1300 and serves to guide hot combustion gas to the turbine 1300. The transition piece 1252 has one longitudinal end coupled to the liner 1251 and the other longitudinal end coupled to the turbine 1300. The flow sleeve 1253 serves to protect the liner 1251 and the transition piece 1252 while preventing high-temperature heat from being directly released to the outside.

Figure 3:
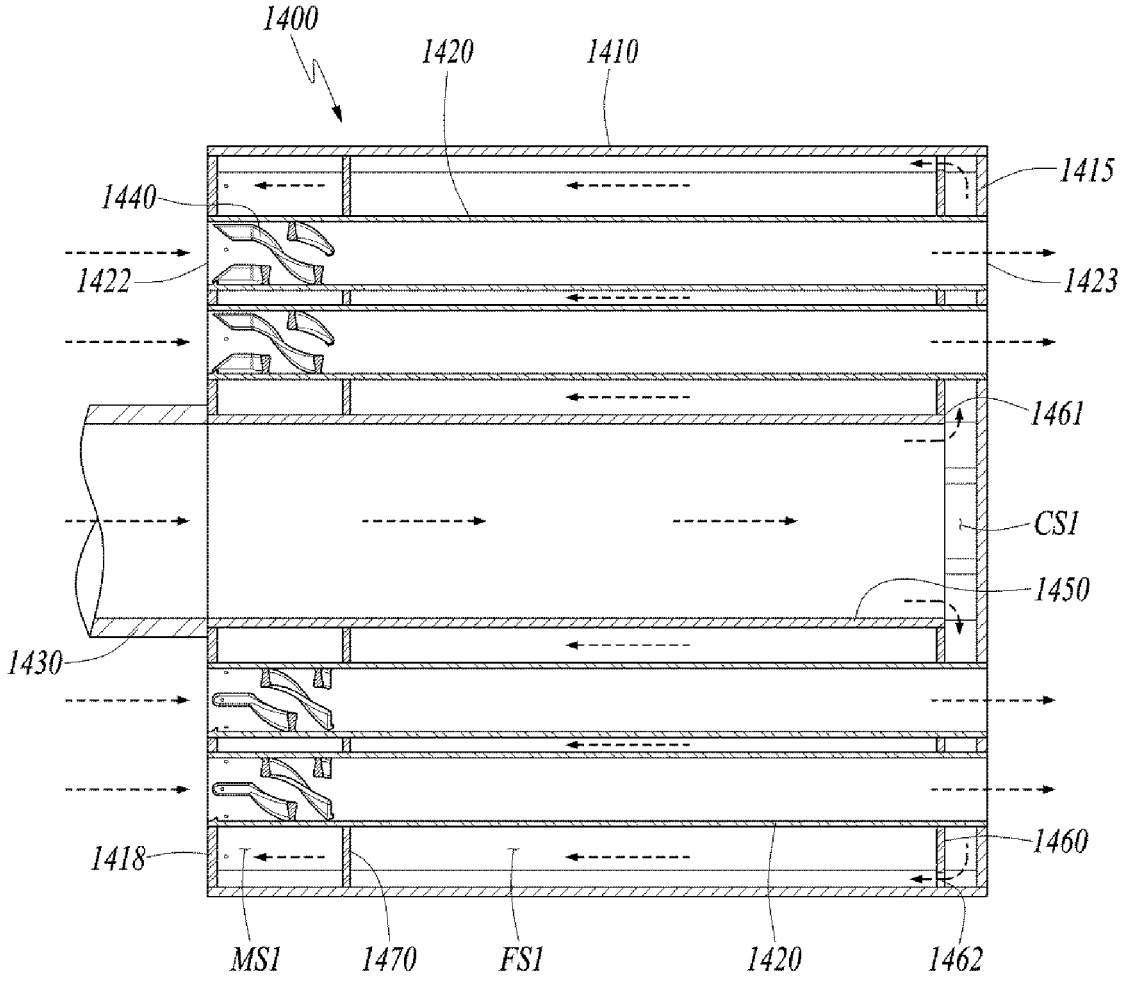
FIG. 3 is a longitudinal cross-sectional view illustrating one nozzle according to the first exemplary embodiment.
Figure 4:
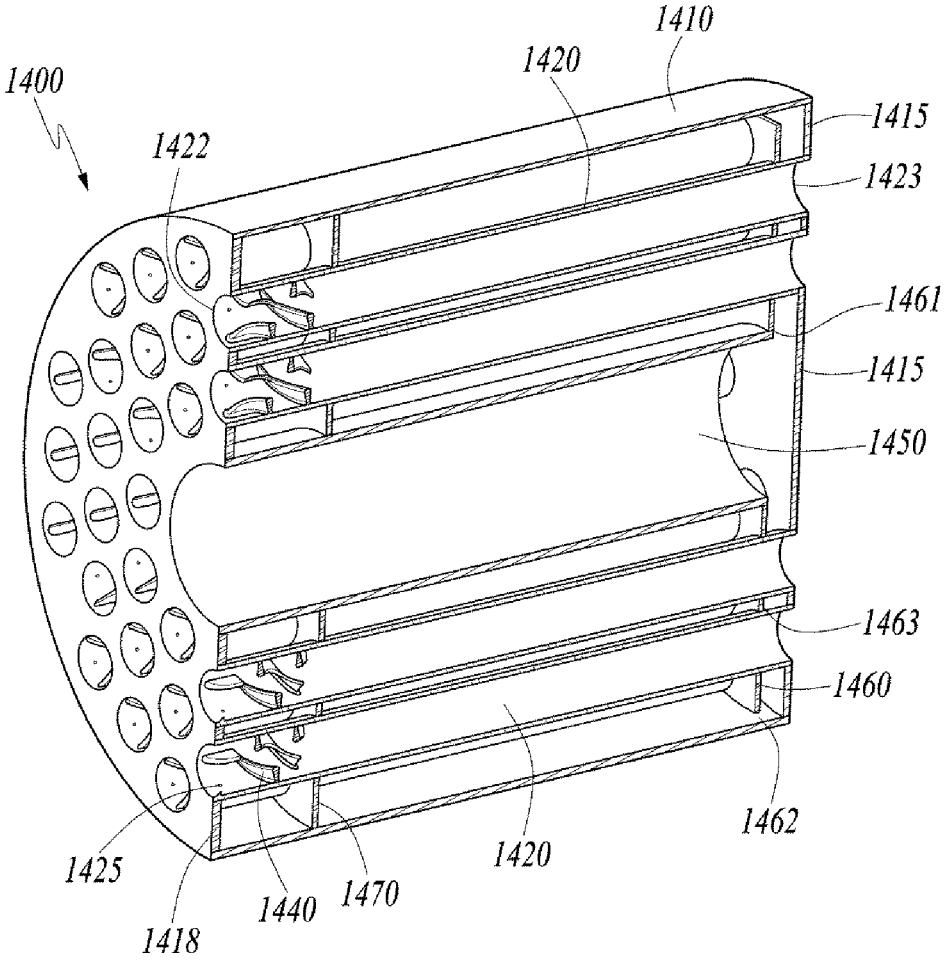
FIG. 4 is a rear cutaway perspective view illustrating the nozzle according to the first exemplary embodiment.
Figure 5:
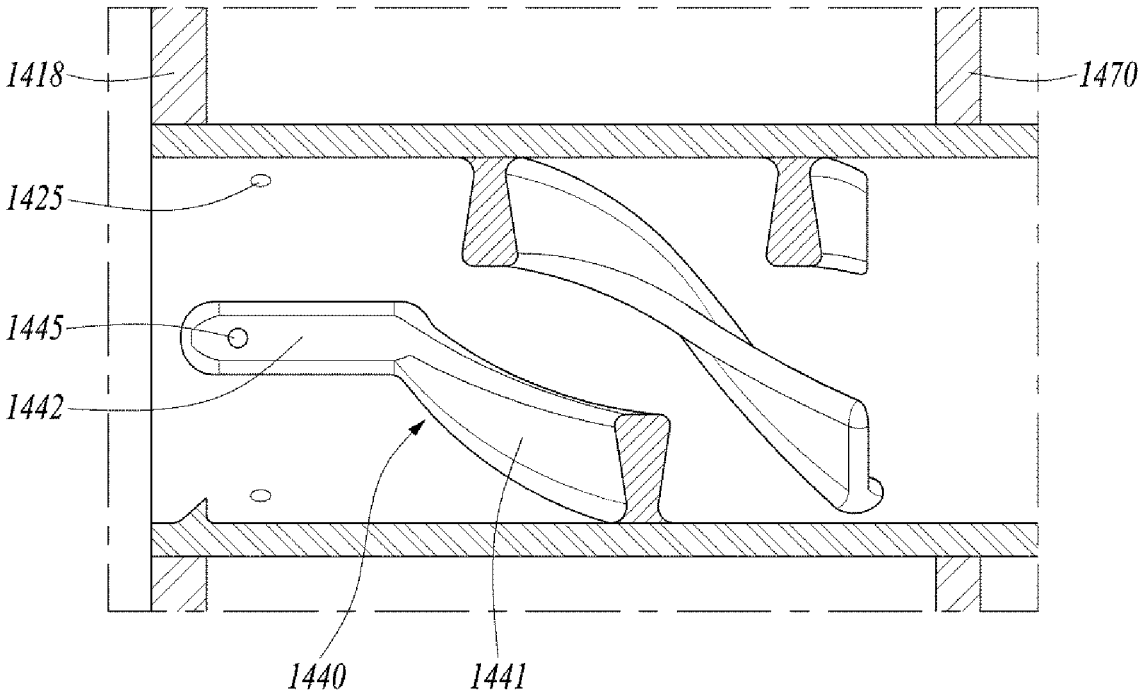
FIG. 5 is a cross-sectional view illustrating a mixing guide according to the first exemplary embodiment.
Figure 6:
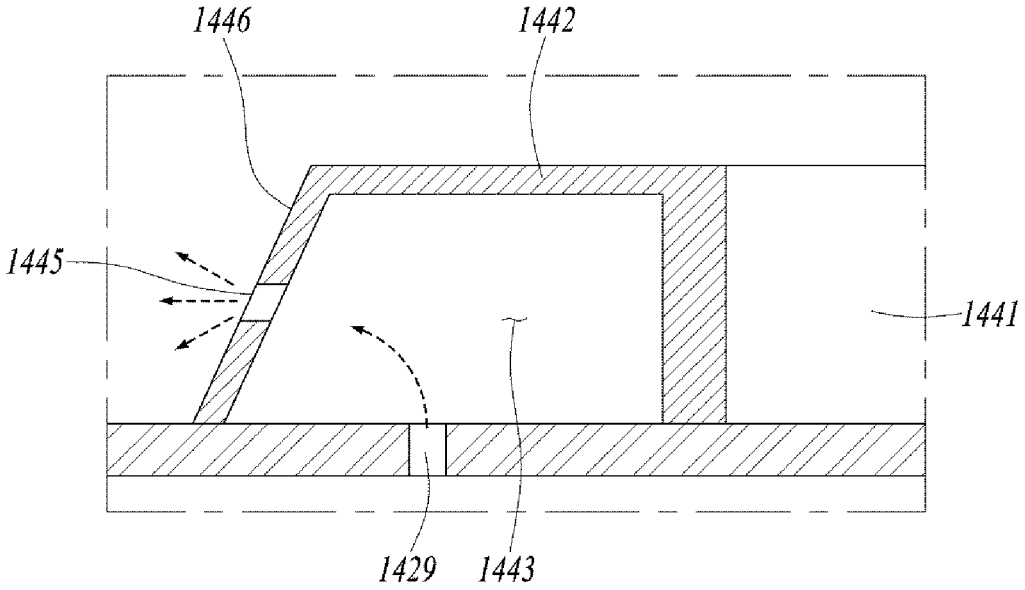
FIG. 6 is a cross-sectional view illustrating a guide plate of the mixing guide according to the first exemplary embodiment.

FIG. 3 is a longitudinal cross-sectional view illustrating one nozzle according to the first exemplary embodiment. FIG. 4 is a rear cutaway perspective view illustrating the nozzle according to the first exemplary embodiment. FIG. 5 is a cross-sectional view illustrating a mixing guide according to the first exemplary embodiment. FIG. 6 is a cross-sectional view illustrating a guide plate of the mixing guide according to the first exemplary embodiment.

Referring to FIGS. 3 to 6, the nozzle 1400 may include a plurality of mixing tubes 1420 through which air and fuel flow, a multi-tube 1410 surrounding the mixing tubes 1420, a fuel tube 1450 formed inside the multi-tube 1410, a tip plate 1415 coupled to the tip of the multi-tube 1410, and a front plate 1460 spaced apart from the tip plate 1415.

The multi-tube 1410 is generally in a cylindrical shape and has a space defined therein. The nozzle 1400 may further include a fuel supply pipe 1430 for supplying fuel to the multi-tube 1410. Here, the fuel may be gas containing hydrogen. The multi-tube 1410 may allow for fine injection of hydrogen and air.

The fuel tube 1450 may be disposed in the radial center of the multi-tube 1410 to provide a flow space of fuel. The direction of the flow of the fuel in the fuel tube 1450 may be referred to as the longitudinal direction or an axial direction. The fuel tube 1450 may have one longitudinal end connected to the fuel supply pipe 1430 to receive fuel, and the other longitudinal end connected to the front plate 1460 to supply fuel to a cooling space CS1. The one longitudinal end of the fuel tube 1450 connected to the fuel supply pipe 1430 may be referred to as an upstream end of the fuel tube 1450 or an rear end of the fuel tube 1450 and the other longitudinal end of the fuel tube connected to the front plate may be referred to as a downstream end of the fuel tube 1450 or an front end of the fuel tube 1450.

The tip plate 1415 is coupled to the tip of the multi-tube 1410 to define the cooling space CS1. The tips of the plurality of mixing tubes 1420 may be inserted into the tip plate 1415. The front plate 1460 is spaced apart from the tip plate 1415 to define the cooling space. In other words, the cooling space CS1 may be disposed between the front plate 1460 and the tip plate 1415. The cooling space CS1 may be disposed between the tip plate 1415 and the front plate 1460 and between the plurality of mixing tubes 1420. The front plate 1460 may be fixed to the inner wall of the multi-tube 1410.

The front plate 1460 may include a center hole 1461 to which the fuel tube 1450 is coupled, and an outer hole 1462 formed outside the center hole 1461 to allow the cooled fuel to flow rearward (upstream direction based on the flow direction of the fuel in the fuel tube 1450) therethrough. In other words, the fuel may flow in the fuel tube 1450 toward the front plate 1460 in the downstream direction, and then flow through the center hole 1461 of the front plate 1460 in the downstream direction, and then flow through the outer hole 1462 of the front plate 1460 in the upstream direction, and then flow away from the front plate 1460 in the upstream direction. When the fuel flows after the center hole 1461 and before the outer hole 1462, the fuel may flow through the cooling space CS1 generally in a direction radially outward from the radial center of the multi-tube 1410. The center hole 1461 may be disposed in the radial center of the front plate 1460, and the outer hole 1462 may be formed at the radially outer end of the front plate 1460. The outer hole 1462 may be formed continuously in a circumferential direction of the front plate 1460, or may consist of a plurality of outer holes spaced apart from each other in the circumferential direction of the front plate 1460.

Accordingly, the fuel introduced into the cooling space CS1 through the center hole 1461 may cool the multi-tube 1410 while flowing radially outwards after impacting and cooling the tip plate 1415, and flow rearward (upstream direction based on the flow direction of the fuel in the fuel tube 1450) through the outer hole 1462. At the rear side of the cooling space CS1, a separate movement space FS1 may be defined by the front plate 1460. In the movement space FS1, the fuel may flow toward the inlet of each mixing tube 1420.

Meanwhile, each of the mixing tubes 1420 may be equipped with a manifold plate 1470 to define a distribution space MS1. The movement space FS1 may be disposed between the front plate 1460 and the manifold plate 1470. A rear plate 1418 may be installed at the rear end of the multi-tube 1410, and the manifold plate 1470 may be spaced apart from the rear plate 1418. The manifold plate 1470 may have a plurality of holes formed therein for flow of fuel.

The distribution space MS1 may be defined between the rear plate 1418 and the manifold plate 1470. The fuel, after flowing from the movement space FS1 to the distribution space MS1, may be injected into each mixing tube 1420 from the distribution space MS1.

The plurality of mixing tubes 1420 may be installed inside the multi-tube 1410 to form several small flames using hydrogen gas. The mixing tubes 1420 may be spaced apart from each other in the multi-tube 1410 and formed parallel to each other. Each of the mixing tubes 1420 may have a cylindrical shape.

The mixing tube 1420 may have an injection port 1423 formed at the front thereof to inject a mixture of air and fuel through the injection port 1423, and an inlet 1422 formed at the rear thereof to introduce air through the inlet 1422.

The mixing tube 1420 may have a plurality of first injection holes 1425 connected to the distribution space MS1. The fuel may be injected into the mixing tube 1420 through the first injection holes 1425 from the distribution space MS1. The first injection holes 1425 may allow fuel to be injected toward the radial center of the mixing tube 1420.

The mixing tube 1420 may be equipped with a mixing guide 1440 therein, which extends spirally and is positioned between the first injection holes 1425. The mixing guide 1440 may be fixed to the inner wall of the mixing tube 1420. Alternatively, the mixing guide 1440 may consist of a plurality of mixing guides spaced apart from each other in the circumferential direction of the mixing tube 1420 on the inner wall of the mixing tube 1420.

The mixing guide 1440 may include a spiral part 1441 extending spirally and a guide plate 1442 protruding from the spiral part 1441 toward the inlet and having a flat shape. The spiral part 1441 may extend spirally to induce a rotational flow, and fuel and air may be uniformly mixed by the rotational flow.

Meanwhile, the guide plate 1442 may have a chamber 1443 for accommodation of fuel therein and a second injection hole 1445 through which fuel is injected. The guide plate 1442 may have a flat shape formed in the axial direction, and the chamber 1443 may be connected to the distribution space MS1 to receive fuel. The guide plate 1442 may have an inclined surface 1446 formed at a portion thereof toward the inlet 1422 to be inclined with respect to the inner peripheral surface of the mixing tube 1420, and the second injection hole 1445 may be formed on the inclined surface 1446. The inclined surface 1446 may be inclined toward the downstream of the mixing tube 1420 as the inclined surface 1446 is formed inwardly from the inner surface of the mixing tube 1420. The second injection hole 1445 may allow fuel to be injected in a direction opposite to the direction of inflow of air, thereby inducing turbulence so that fuel and air may be uniformly mixed.

Hereinafter, one nozzle according to a second exemplary embodiment will be described.

Figure 7:
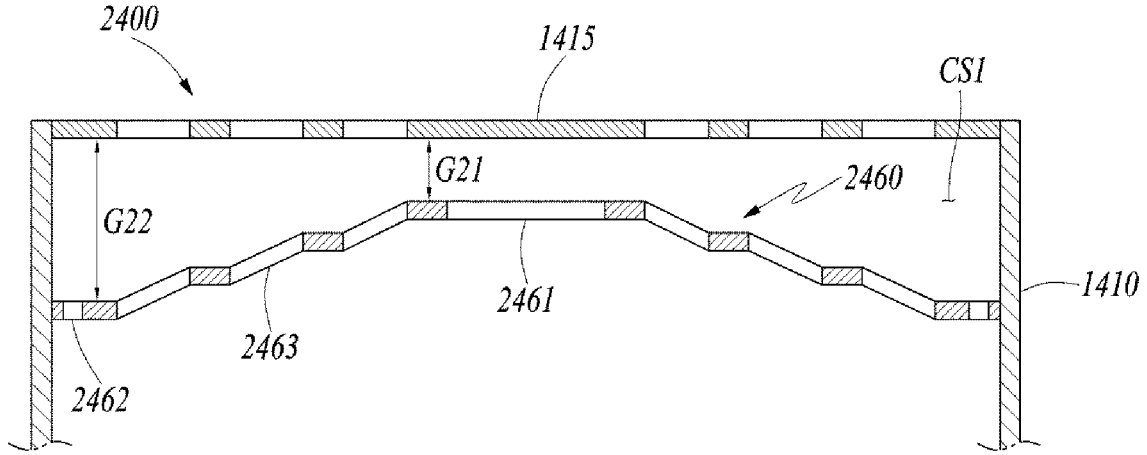
FIG. 7 is a cross-sectional view illustrating a front plate and a tip plate according to a second exemplary embodiment.

FIG. 7 is a cross-sectional view illustrating a front plate and a tip plate according to the second exemplary embodiment.

Referring to FIG. 7, since the nozzle, which is designated by reference numeral 2400, according to the second exemplary embodiment has the same structure as the nozzle according to the first exemplary embodiment, except for a front plate, a redundant description thereof will be omitted.

The tip plate 1415 is coupled to the tip of the multi-tube 1410. The tips of the plurality of mixing tubes may be inserted into the tip plate 1415. The front plate, which is designated by reference numeral 2460, is spaced apart from the tip plate 1415 to define the cooling space CS1. The cooling space CS1 may be disposed between the tip plate 1415 and the front plate 2460 and between the plurality of mixing tubes. The front plate 2460 and the tip plate 1415 may be fixed to the inner wall of the multi-tube 1410.

The front plate 2460 may include a center hole 2461 to which the fuel tube is coupled, and an outer hole 2462 formed radially outside the center hole 2461 to allow the cooled fuel to flow rearward (upstream direction based on the flow direction of the fuel in the fuel tube 1450) therethrough. In addition, the front plate 2460 may have an installation hole 2463 into which the mixing tube 2420 is inserted.

The first gap G21 between the radially central portion of the front plate 2460 and the tip plate 1415 may be smaller than the second gap G22 between the radially outer portion of the front plate 2460 and the tip plate 1415. The front plate 2460 may include a portion parallel to the tip plate 1415 and a portion inclined rearward with respect to the tip plate 1415.

Accordingly, the front plate 2460 may be formed to have at least one inclined portion and at least one parallel portion, such that each of the inclined portion is inclined rearward step by step, and the at least one parallel portion is parallel to the radially central portion of the front plate 2460 and the gap between the front plate 2460 and the tip plate 1415 increases step by step toward the outside. The fuel introduced into the central portion of the nozzle may be heated and flow outwards, in which case, if the amount of fuel accommodated in the outer portion of the nozzle increases, that portion may also be sufficiently cooled by the fuel.

Hereinafter, one nozzle according to a third exemplary embodiment will be described.

Figure 8:
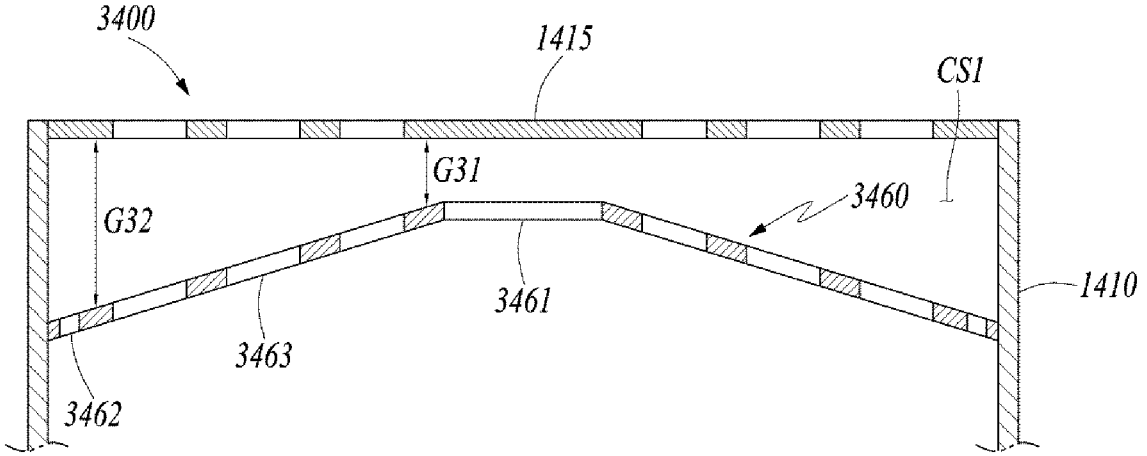
FIG. 8 is a cross-sectional view illustrating a front plate and a tip plate according to a third exemplary embodiment.

FIG. 8 is a cross-sectional view illustrating a front plate and a tip plate according to the third exemplary embodiment.

Referring to FIG. 8, since the nozzle, according to the third exemplary embodiment has the same structure as the nozzle according to the first exemplary embodiment, except for a redundant description thereof will be omitted.

The tip plate 1415 is coupled to the tip of the multi-tube 1410. The tips of the plurality of mixing tubes may be inserted into the tip plate 1415. The front plate, which is designated by reference numeral 3460, is spaced apart from the tip plate 1415 to define the cooling space CS1. The cooling space CS1 may be disposed between the tip plate 1415 and the front plate 3460 and between the plurality of mixing tubes. The front plate 3460 and the tip plate 1415 may be fixed to the inner wall of the multi-tube 1410.

The front plate 3460 may include a center hole 3461 to which the fuel tube 1450 is coupled, and an outer hole 3462 formed outside the center hole 3461 to allow the cooled fuel to flow rearward (upstream direction based on the flow direction of the fuel in the fuel tube 1450) therethrough. In addition, the front plate 3460 may have an installation hole 3463 into which the mixing tube is inserted.

The first gap G31 between the radially central portion of the front plate 3460 and the tip plate 1415 may be smaller than the second gap G32 between the radially outer portion of the front plate 3460 and the tip plate 1415. The front plate 3460 may have a truncated cone shape such that the portion other than the radially central portion of the front plate is inclined rearward from the radial center thereof toward the outside.

Accordingly, the front plate 3460 may be inclined rearward, and the gap between the front plate 3460 and the tip plate 1415 increases continuously and gradually toward the outside. The fuel introduced into the central portion of the nozzle may be heated and flow outwards, in which case, if the amount of fuel accommodated in the outer portion of the nozzle increases, that portion may also be sufficiently cooled by the fuel.

Based on the above description, in the combustor nozzle, the combustor, and the gas turbine according to the exemplary embodiments, the cooling space may be defined between the tip plate and the front plate. Therefore, it is possible to efficiently cool the tip part of the nozzle by supplying fuel to the cooling space.

While one or more exemplary embodiments have been described with reference to the accompanying drawings, it will be apparent to those skilled in the art that various variations and modifications may be made by adding, changing, or removing components without departing from the spirit and scope of the disclosure as defined in the appended claims, and these variations and modifications fall within the spirit and scope of the disclosure as defined in the appended claims. Also, it is noted that any one feature of an embodiment of the present disclosure described in the specification may be applied to another embodiment of the present disclosure

What is claimed is:

1. A nozzle for a combustor that burns fuel containing hydrogen, comprising:

a plurality of mixing tubes through which air and fuel flow;

a multi-tube configured to contain and support the mixing tubes;

a fuel tube formed inside the multi-tube and through which the fuel flows;

a tip plate coupled to a tip of the multi-tube; and a front plate spaced apart from the tip plate to define a cooling space, wherein the front plate includes a plurality of parallel portions parallel to the tip plate and a plurality of inclined portions inclined rearward with respect to the tip plate, and each of the parallel portions and inclined portions are placed alternately.

2. The nozzle according to claim 1, wherein the front plate comprises a center hole connected to the fuel tube, and an outer hole disposed outside the center hole to allow the fuel to pass therethrough.

3. The nozzle according to claim 1, wherein the multi-tube is equipped with a rear plate disposed at a rear end thereof, and with a manifold plate spaced apart from the rear plate to define a distribution space.

4. The nozzle according to claim 1, wherein each of the mixing tubes is equipped with at least one mixing guide extending spirally.

5. The nozzle according to claim 4, wherein:

the at least one mixing guide consists of a plurality of mixing guides installed in the mixing tube; and the mixing guides are fixed to an inner wall of the mixing tube and spaced apart from each other in a circumferential direction of the mixing tube.

6. The nozzle according to claim 5, wherein each of the mixing guides comprises a spiral part extending spirally and a guide plate protruding from the spiral part toward an inlet and having a flat shape.

7. The nozzle according to claim 6, wherein the mixing tube comprises an inlet formed at one longitudinal end thereof to introduce air through the inlet, an injection port formed at the other longitudinal end thereof to inject, a mixture in which fuel and the air are premixed, through the injection port, and a first injection hole formed on an outer peripheral surface thereof to inject the fuel to the inside through the first injection hole.

8. The nozzle according to claim 6, wherein the guide plate has a chamber for accommodation of fuel therein and a second injection hole through which fuel is injected.

9. The nozzle according to claim 8, wherein the guide plate has an inclined surface formed at a portion thereof toward the inlet to be inclined with respect to an inner peripheral surface of the mixing tube, and the second injection hole is formed on the inclined surface.

10. The nozzle according to claim 1, wherein a first gap between a radially central portion of the front plate and the tip plate is smaller than a second gap formed between a radially outer portion of the front plate and the tip plate.

11. A combustor comprising a burner having a plurality of nozzles for injecting fuel and air, and a duct assembly coupled to one side of the burner to burn a mixture of the fuel and the air therein and transmit combustion gas to a turbine, wherein each of the nozzles comprises:

a plurality of mixing tubes through which air and fuel flow;

a multi-tube configured to contain and support the mixing tubes;

a fuel tube formed inside the multi-tube and through which the fuel flows;

a tip plate coupled to a tip of the multi-tube; and a front plate spaced apart from the tip plate to define a cooling space, wherein the front plate includes a plurality of parallel portions parallel to the tip plate and a plurality of inclined portions inclined rearward with respect to the tip plate, and each of the parallel portions and inclined portions are placed alternately.

12. The combustor according to claim 11, wherein the front plate comprises a center hole connected to the fuel tube, and an outer hole disposed outside the center hole to allow the fuel to pass therethrough.

13. The combustor according to claim 11, wherein the multi-tube is equipped with a rear plate disposed at a rear end thereof, and with a manifold plate spaced apart from the rear plate to define a distribution space.

14. The combustor according to claim 11, wherein each of the mixing tubes is equipped with a plurality of mixing guides extending spirally, and the mixing guides are fixed to an inner wall of the mixing tube and spaced apart from each other in a circumferential direction of the mixing tube.

15. The combustor according to claim 14, wherein each of the mixing guides comprises a spiral part extending spirally and a guide plate protruding from the spiral part toward an inlet and having a flat shape.

16. The combustor according to claim 15, wherein the guide plate has a chamber for accommodation of fuel therein and a second injection hole through which fuel is injected.

17. A gas turbine comprising a compressor configured to compress air introduced thereinto from the outside, a combustor configured to mix fuel with the air compressed by the compressor for combustion, and a turbine having a plurality of turbine blades rotated by combustion gas produced by the combustion in the combustor, wherein the combustor comprises a burner having a plurality of nozzles for injecting the fuel and the air, and a duct assembly coupled to one side of the burner to burn a mixture of the fuel and the air therein and transmit the combustion gas to the turbine, and wherein each of the nozzles comprises:

a plurality of mixing tubes through which air and fuel flow;

a multi-tube configured to contain and support the mixing tubes;

a fuel tube formed inside the multi-tube and through which the fuel flows;

a tip plate coupled to a tip of the multi-tube; and a front plate spaced apart from the tip plate to define a cooling space, wherein the front plate includes a plurality of parallel portions parallel to the tip plate and a plurality of inclined portions inclined rearward with respect to the tip plate, and each of the parallel portions and inclined portions are placed alternately.

18. The gas turbine according to claim 17, wherein the front plate comprises a center hole connected to the fuel tube, and an outer hole disposed outside the center hole to allow the fuel to pass therethrough.

19. The gas turbine according to claim 17, wherein each of the mixing tubes is equipped with a plurality of mixing guides extending spirally, and the mixing guides are fixed to an inner wall of the mixing tube and spaced apart from each other in a circumferential direction of the mixing tube.

* * * * *